US005662458A

United States Patent [19]

Owen

[11] Patent Number: 5,662,458

[45] Date of Patent: Sep. 2, 1997

[54] BLADED ROTOR WITH RETENTION PLATES AND LOCKING MEMBER

[75] Inventor: Brian C. Owen, Derby, England

[73] Assignee: Rolls-Royce plc, London, England

[21] Appl. No.: 694,090

[22] Filed: Aug. 8, 1996

[30] Foreign Application Priority Data

Aug. 24, 1995 [GB] United Kingdom ..... 9517369

[51] Int. Cl.[6] ..... F01D 5/10; F01D 5/32

[52] U.S. Cl. ..... 416/145; 416/193 A; 416/220 R

[58] Field of Search ..... 416/144, 145, 416/193 A, 220 R, 221, 248, 500

[56] References Cited

U.S. PATENT DOCUMENTS

| | | | |
|---|---|---|---|
| 4,108,571 | 8/1978 | Mauson | 416/221 |
| 4,730,983 | 3/1988 | Naudet et al. | 416/220 R |
| 5,256,035 | 10/1993 | Norris et al. | 416/220 R |

FOREIGN PATENT DOCUMENTS

| | | |
|---|---|---|
| 954323 | 4/1964 | United Kingdom . |
| 2012007 | 7/1979 | United Kingdom . |
| 2258273 | 2/1993 | United Kingdom . |

OTHER PUBLICATIONS

Great Britain Search Report for Great Britain Application 9517369.6, dated Nov. 13, 1995.

*Primary Examiner*—Christopher Verdier

*Attorney, Agent, or Firm*—Cushman Darby & Cushman IP Group of Pillsbury Madison & Sutro LLP

[57] ABSTRACT

A bladed rotor for the high pressure compressor of a gas turbine engine comprises a disc carrying an annular array of aerofoil blades in axially extending fir tree root slots. Retention plates carried in radially inner and outer slots prevent axial movement of the blade roots in their slots. A locking member is interposed between an adjacent pair of retention plates to prevent their circumferential movement relative to the disc. The locking member in turn interacts with the disc to anchor itself to the disc.

11 Claims, 3 Drawing Sheets

BLADED ROTOR WITH RETENTION PLATES AND LOCKING MEMBER

BACKGROUND OF THE INVENTION

This invention relates to a bladed rotor for a gas turbine engine and is particularly concerned with the fixing of the aerofoil blades on such a bladed rotor.

Gas turbine engines commonly include an axial flow compressor that comprises a plurality of axially spaced apart bladed rotors. Each of the rotors comprises a disc carrying an annular array of radially extending aerofoil blades on its periphery. Each aerofoil blade is provided with a root at its radially inner end that locates in an appropriately shaped axially extending slot in the disc periphery. This root may conveniently be of the so-called "dovetail" configuration. The root is slid axially into its disc retention slot so that the dovetail configuration of the root and its retention slot provide radial retention of the blade.

It is necessary to provide some means for axially retaining each aerofoil blade in its disc slot. One way of achieving this is to position an axially extending removable clip between the base of each blade root and its corresponding retention slot. One end of the clip is bent around the disc and the other around the blade root so that the clip prevents axial movement of the blade in one direction. Movement in the opposite direction is prevented by a small integral location feature provided on the blade root that abuts the disc.

While such clips are effective in providing axial blade root retention, they do allow air to leak through the small gaps that inevitably exist between each blade root and its retention slot. Such leakage is undesirable in view of the detrimental effect that it can have upon overall compressor efficiency.

Another way of achieving axial aerofoil blade retention is to position an annular array of retention plates over the ends of the blade roots and the adjacent axial surface of the disc. Such plates are effective in preventing axial blade movement and also in preventing air leakage between the blade roots and their location slots. There are, however, difficulties in retaining the plates in position. One convenient way of providing plate retention is to locate each plate between radially spaced apart annular slots provided on the disc and on the platforms of the aerofoil blades. The radially inner slot is defined by the disc and is radially outwardly directed wherein the radially outer slot is defined by both the disc and the blade platform and is radially inwardly directed. It is necessary, however, to provide some way of preventing relative movement between the plates and the disc to avoid the blade/disc assembly becoming unbalanced. Clamps or other similar retention devices could be used to provide plate retention. However, such devices usually give rise to windage effects which in turn adversely affect compressor efficiency.

It is an object of the present invention to provide a gas turbine engine bladed rotor in which the aerofoil blades are fixed to the disc in such a manner that such difficulties are substantially avoided.

SUMMARY OF THE INVENTION

According to the present invention a bladed rotor for a gas turbine engine comprises a rotor disc having a plurality of rotor aerofoil blades attached to and extending radially from its periphery region, each of said aerofoil blades having a root portion which is located in a correspondingly shaped generally axially extending slot provided in said rotor disc periphery region to facilitate the radial fixing of each of said aerofoil blades on said rotor disc and an annular array of circumferentially adjacent retention plates positioned axially adjacent said aerofoil blade roots to facilitate axial aerofoil blade fixing on said rotor disc at least in one axial direction, at least said disc defining confronting radially spaced apart annular slots to receive and axially locate said retention plates, and at least one locking member, a first portion of which is interposed between an adjacent pair of said retention plates and is contiguous with the exposed surface of said pair of retention plates, a second portion of said locking member being so configured as to interact with a corresponding feature on said disc to prevent circumferential movement of said locking member, and hence circumferential movement of said retention plates, relative to said rotor disc, said second portion of said locking member being configured to be contiguous with the exposed surfaces of said rotor disc, said locking member being provided with a third portion adapted to co-operate with said adjacent pair of retention plates to prevent axial movement of said locking member relative to said disc.

The present invention will now be described by way of example, with reference to the accompanying drawings in which:

DESCRIPTION OF THE PREFERRED EMBODIMENT

Figure 1:
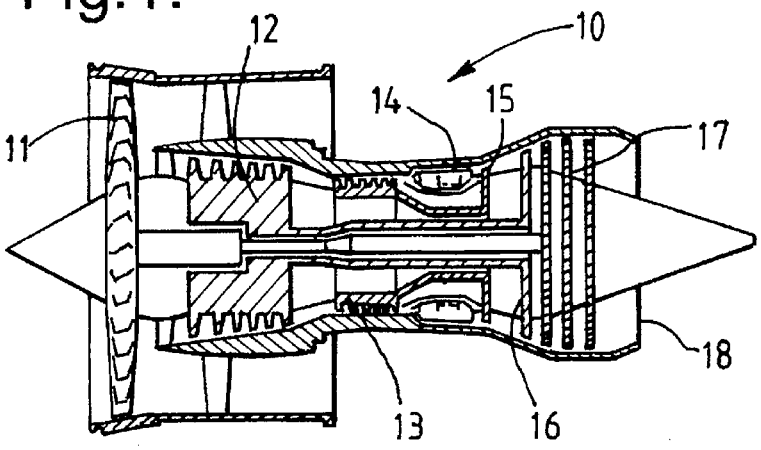
FIG. 1 is a schematic sectioned side view of a ducted fan gas turbine engine that includes a bladed rotor in accordance with the present invention.

With reference to FIG. 1, a ducted fan gas turbine engine generally indicated at 10 is of conventional overall configuration. It comprises, in axial flow series, a ducted fan 11, intermediate pressure compressor 12, high pressure compressor 13, combustion equipment 14, high intermediate and low pressure turbines 15,16 and 17 respectively and an exhaust nozzle 18.

The engine functions in the usual manner in which air accelerated by the fan 11 is divided into two flows: the first of which is exhausted from the engine 10 to provide propulsive thrust and the second of which is directed into the intermediate pressure compressor 12. There the air is pressurised before being directed into the high pressure compressor 13 where further pressurisation takes place. The pressurised air exhausted from the high pressure compressor 13 is mixed with fuel and the mixture combusted in the combustion equipment 14. The resultant hot combustion products then expand through and thereby drive the high, intermediate and low pressure turbines 15,16 and 17 before being exhausted to atmosphere through the nozzle 18. Various concentric shafts drivingly interconnect the various turbine sections of the engine 1 with its compressor and fan sections.

Figure 2:
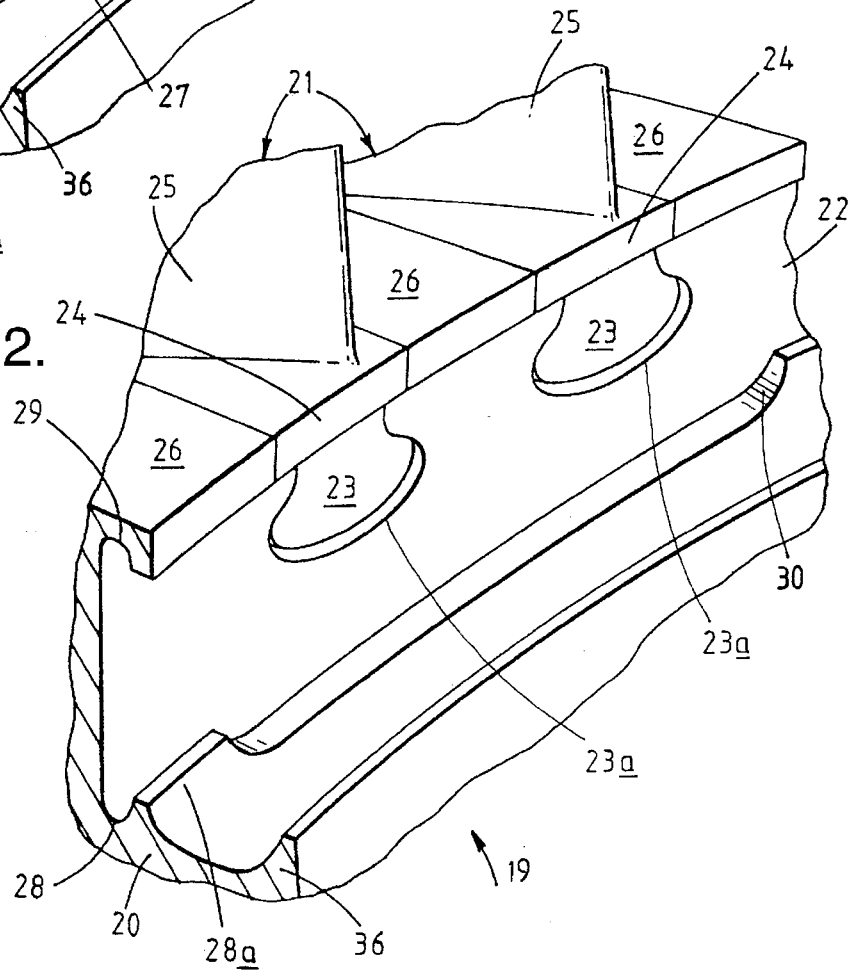
FIG. 2 is an isometric view of a portion of the peripheral region of a bladed rotor in accordance with the present invention in a partially assembled condition.

The present invention is particularly concerned with the bladed rotors which are included in the high pressure compressor 13 although it will be appreciated that it is also applicable to bladed rotors in the compressor 12 or indeed to those in the turbine sections 15, 16 and 17 of the engine 10. Each bladed rotor 19, a portion of the peripheral region of one of which can be seen in FIG. 2, comprises a rotor disc 20 having a plurality of similar rotor aerofoil blades 21 attached to and extending radially from its peripheral region 22. Each aerofoil blade 21 has a root portion 23, a platform 24 and an aerofoil portion 25. The platform 24 is interposed between the aerofoil portion 25 and the root portion 23 and serves to define a part of the radially inner extent of the air path through the high pressure compressor 13. A further part of that radially inner extent of the air path is defined by portions 26 of the disc peripheral region 22 that are circumferentially interposed between adjacent aerofoil blade platforms 24. It will be seen therefore that the platforms 24 and the disc peripheral portions 26 co-operate to define an annular surface that constitutes an axial portion of the radially inner extent of the air path through the high pressure compressor 13.

Each blade root 23 is of the well known "dovetail" cross-section configuration and slidingly locates in an axial slot 23*a* of corresponding configuration provided in the disc peripheral region 22. The "dovetail" configuration of each aerofoil blade root 23 facilitates radial fixing of its aerofoil blade 21 on the rotor disc 20. It will be appreciated however that other suitable root configurations, such as the well-known "fir tree" configuration, could be so used if so desired.

Figure 3:
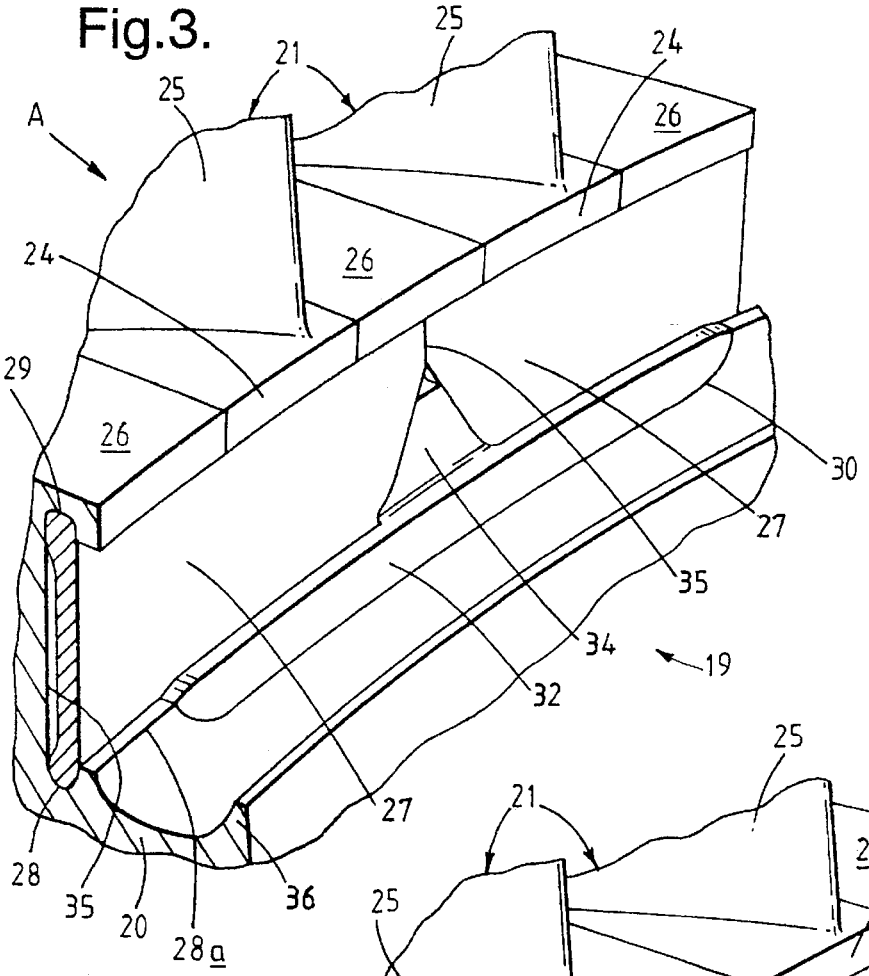
FIG. 3 is a view similar to that shown in FIG. 2 in which the bladed rotor is in a fully assembled condition.

Axial fixing of the aerofoil blades 21 on the rotor disc 20 is provided by an annular array 6f circumferentially adjacent retention plates 27, two of which can be seen if reference is now made to FIG. 3. The retention plates 27 although not identical are all of generally similar configuration and are axially retained by confronting radially spaced apart annular slots 28 and 29. The radially inner slot 28 is radially outwardly directed and is defined by the disc peripheral portion 22 and a radially outwardly extending flange 28*a* that is part of a seal element carrier 36 integral with the disc 20. However, the radially outer slot 29, which is radially inwardly directed, is defined by both the disc peripheral regions 26 and the aerofoil blade platforms 24. It will be seen therefore that axial movement of the aerofoil blades 21 relative to the rotor disc 20 in the direction towards the retention plates 27 is restrained by the abutment of the blade roots 23 with the retention plates 27 which are in turn restrained through their interaction with the slots 28 and 29. Axial movement in the opposite direction, that is away from the retention plates 27 is restrained by the retention plates 27 through their interaction with the parts of the radially outer slot 29 that are defined by the aerofoil blade platforms 24. Thus the loads imposed upon the retention plates 27 in providing axial constraint of the aerofoil blades 21 are all in shear.

It will be appreciated, however, that it is not essential that the retention plates 27 should provide constraint of the aerofoil blades 21 in both axial directions. It may, for instance, be desirable under certain circumstances to only provide axial aerofoil blade 21 constraint in the direction towards the retention plates 27. Axial constraint in the opposite direction could conveniently be provided by an integral extension piece on the axial extent of the blade root 23 that is located adjacent the retention plates 27. Such an extension piece would engage the surface of the disc peripheral region 22 adjacent the retention plates 27, thereby limiting movement of the aerofoil blade 21 in the axial direction away from the retention plates 27. If such a method of providing axial aerofoil blade retention were to be employed, it would be possible in turn to modify the relationship between the aerofoil blade platforms 24 and the peripheral portions 26 of the rotor disc 20. Indeed the disc peripheral portions 26 could be dispensed with altogether so that the platforms 24 of adjacent aerofoil blades 21 are themselves adjacent each other. Such an arrangement could be desirable if, for instance, it was necessary to increase the number of rotor aerofoil blades 21 carried by the disc 20. This could be necessary in the case of aerofoil blade/disc assemblies that are of relatively small diameter.

Although the primary function of the retention plates 27 is to prevent axial movement of the aerofoil blades 21 relative to the disc 20, it will be appreciated that they also serve to cover one end of each of the aerofoil blade roots 23, thereby inhibiting the possible leakage of air through the small gaps that inevitably exist between the aerofoil blade roots 23 and the slots 23*a* in which they locate.

The bladed rotor 19 is assembled by initially sliding axially the roots 23 of each of the rotor aerofoil blades 21 into their corresponding disc slots 23*a*. The retention plates 27 are then fed into the slots 28 and 29 through a loading slot 30 that is provided in the lower retention plate slot 28. The loading slot 30 is of sufficient circumferential extent to accommodate one of the retention plates 27 and is of the same radial depth as the radially inner slot 28.

Sufficient retention plates 27 are loaded into the radially inner and outer slots 28 and 29 to almost define a fully annular array of plates 27. However several spaces are left to permit the insertion of locking plates as will be described later.

When the final two retention plates 27 have been inserted into the loading slot 30, they are circumferentially separated so that a gap exists between them in the region of the loading slot 30 that is of greater circumferential extent than that of the loading slot 30. The previously mentioned omission of the locking plates permits this circumferential separation. A locking member 31, which can be seen in FIGS. 4 and 5 and is partially visible in FIG. 3, is then positioned between the separated retention plates 27.

The locking member 31 has an elongate lower portion 32 that corresponds in shape with and locates in the loading slot 30. However it is of greater axial extent than the loading slot 30 so that it protrudes into the radially inner slot 28. Nevertheless in all other respects, it corresponds in configuration with the flange 28*a* to thereby blend with the flange 28*a*. The flange 28*a* together with the locking member 31 lower portion thus co-operate to define an annular flange that defines smooth surfaces. Such smooth surfaces are important in minimising the windage produced during the rotation of the disc 20.

A thin locking portion 33 extends radially outwardly from the lower portion 31 of the locking member 31 and abuts the disc peripheral portion 22. It is of lesser radial extent than that of the retention plates 27 and supports a truncated triangular feature 34 on the opposite side thereof to that adjacent the disc peripheral portion 22. The truncated triangular feature 34 is also supported by the locking member lower portion 32. Thus the truncated triangular feature 34 extends axially from the locking portion 33 and radially from the lower portion 32.

The radially inner and outer edges of the retention plates 27 are thickened so that a small circumferentially extending axial gap 35, which can be seen in FIG. 3 is defined between the radially mid regions of the retention plates 27 and the disc peripheral region 22. This aids the circumferential sliding of the retention plates 27 in the slots 28 and 29.

The difference between the thickness of the radially inner and outer edges of the retention plates 27 and the remainder of the retention plates 27 is equal to the thickness of the locking member locking portion 33. This, together with the partial absence of the thickening on the radially inner edges of the two final retention plates 27, permits the two final retention plates 27 to be slid circumferentially towards each other over the locking member locking portion 33.

Figure 4:
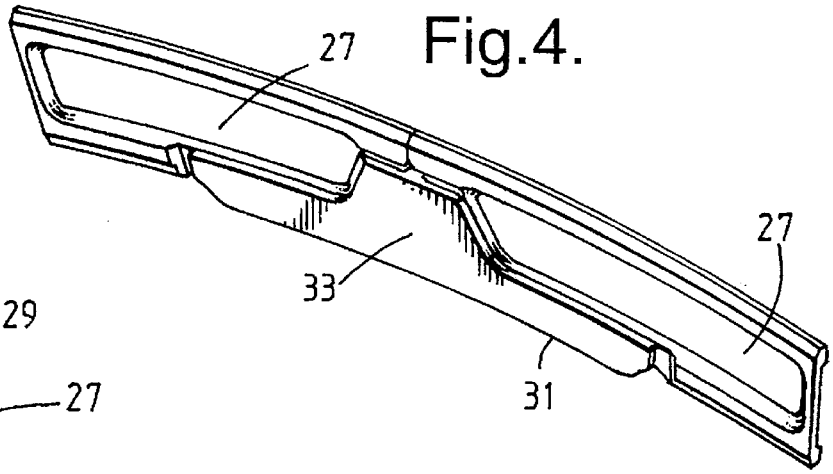
FIG. 4 is a view in the direction of arrow A in FIG. 3 in which the aerofoil blades and rotor discs have been omitted in the interests of clarity.
Figure 5:
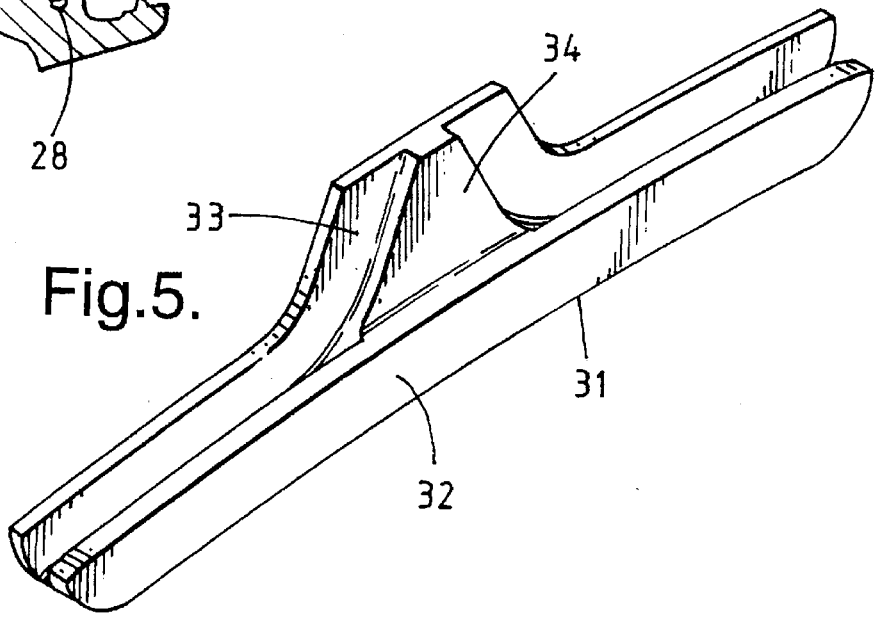
FIG. 5 is an isometric view of a key member for use with the bladed rotor of the present invention.

The two final retention plates 27 engage each other at the radially outer extents of their circumferentially adjacent edges 35 as can be seen in FIGS. 3 and 4. However the remainder of the circumferentially adjacent edges 35 are chamfered so as to accommodate the truncated triangular feature 34 of the locking member 31. The locking member truncated triangular feature 34 is arranged to be of the same axial thickness as that of the retention plates 27 so that it blends with the plates 27 to define a smooth contiguous surface as is apparent from FIG. 3. Thus as in the case of the locking member lower portion 32 and the flange 28*a*, the definition of a smooth contiguous surface minimises the windage produced during the rotation of the disc 20.

Figure 7:
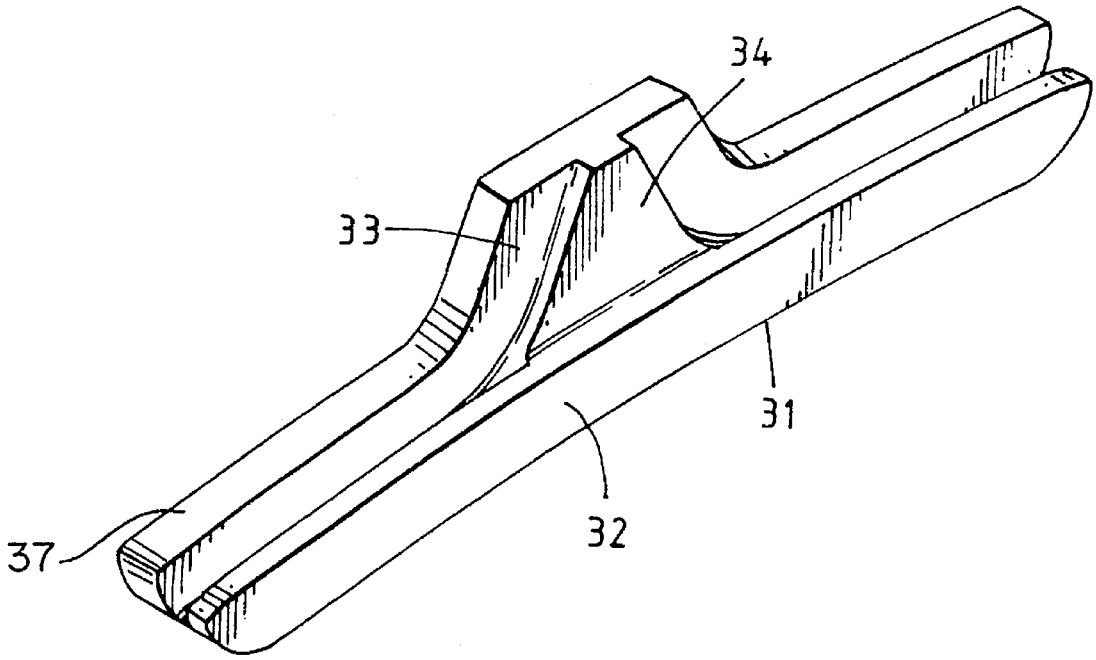
FIG. 7 is a view showing some of the retention plates being of various thicknesses.

When the two final retention plates 27 have been slid together, there are, as previously stated, gaps remaining elsewhere in the array of retention plates 27. This enables the remaining retention plates 27 to be slid circumferentially until they are so positioned that the bladed rotor 19 will be balanced when provided with a fully annular complement of retention plates 27. To facilitate this, some of the retention plates 27 are arranged to be of variable thickness, and hence variable weight as shown in FIG. 7.

Figure 6:
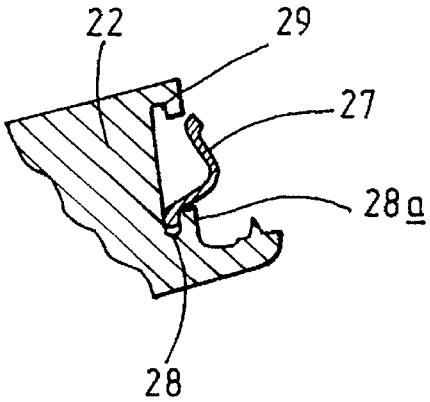
FIG. 6 is a sectional side view of the peripheral portion of the bladed rotor in accordance with the present invention showing the manner in which the final retention plates are attached to the rotor disc.

When the retention plates 27 have been finally positioned, the remaining gaps in the array of retention plates 27 are filled with the previously mentioned locking retention plates 27. These locking retention plates 27 are of the same general configuration as the remaining plate 27, differing only in that they are axially bent as shown in FIG. 6. Thus locking retention plates 27 are placed against the disc peripheral region 22 as shown in FIG. 6 and then flattened by a suitable tool until their radially inner and outer edges locate in the slots 28 and 29.

The two final retention plates 27 are each of such circumferential extent that together their total circumferential extent is greater than that of the loading slot 30. Consequently the two final retention plates 27 engage in both the radially inner and outer slots 28 and 29, thereby providing axial constraint of the locking member 31 and consequently preventing its removal. The locking member 31 in turn prevents circumferential sliding of the retention plates 27 in the grooves 28 and 29 by virtue of its interaction with them via its truncated triangular feature 34. The locking member 31 is itself prevented from moving circumferentially relative to the disc 20 by virtue of the interaction of its lower portion 32 with the loading slot 30.

The locking member 31 thus provides effective circumferential locking of the retention plates 27 without defining undesirable surface features which could give rise to windage effects.

Although the present invention has been described with reference to a bladed rotor 19 with a single locking member 31, it may be desirable under certain circumstances to provide more than one such locking member 31. Additionally, although the portion 34 of the locking member 31 interposed between the two retention plates 27 is of truncated triangular configuration this is not essential and it could be of other convenient configuration. It could, for instance be fully interposed between the retention plates 27 so that the plates do not engage each other but only engage the portion 34 of the locking member.

I claim:

1. A bladed rotor for a gas turbine engine comprising a rotor disc having a peripheral region, a plurality of rotor aerofoil blades, said rotor aerofoil blades being attached to and extending radially from said peripheral region, each of said aerofoil blades having a root portion, which is located in a correspondingly shaped generally axially extending slot provided in said rotor disc peripheral region to facilitate radial fixing of each of said aerofoil blades on said rotor disc, and an annular array of circumferentially adjacent retention plates axially adjacent said aerofoil blade roots to facilitate axial aerofoil blade fixing on said rotor disc at least in one axial direction, at least said disc defining confronting radially spaced apart annular slots to receive and axially locate said retention plates, and at least one locking member, a first portion of which is interposed between an adjacent pair of said retention plates and is contiguous with exposed surfaces of said pair of retention plates, a second portion of said locking member being so configured as to interact with a corresponding feature on said disc to prevent circumferential movement of said locking member, and hence circumferential movement of said retention plates, relative to said rotor disc, said second portion of said locking member being configured to be contiguous with exposed surfaces of said rotor disc, said locking member being provided with a third portion adapted to co-operate with said adjacent pair of retention plates to prevent axial movement of said locking member relative to said disc.

2. A bladed rotor for a gas turbine engine as claimed in claim 1 wherein said third portion of said locking member is interposed between said adjacent pair of retention plates and the peripheral region of said disc to prevent the axial movement of said locking member relative to said disc.

3. A bladed rotor as claimed in claim 1 wherein one of said confronting radially spaced apart annular slots is provided with a loading slot to facilitate loading of said retention plates into said annular slots, said second portion of said locking member locating in said loading slot to prevent the circumferential movement of said locking member relative to said disc.

4. A bladed rotor as claimed in claim 3 wherein said radially inner retention plate slot is provided with said loading slot.

5. A bladed rotor as claimed in claim 1 wherein said first portion of said locking member interposed between said adjacent pair of retention plates is of truncated triangular configuration, the circumferentially adjacent edges of said retention plates being configured so as to correspond with the configuration of said first portion of said locking member.

6. A bladed rotor as claimed in claim 5 wherein said locking member first portion is of lesser radial extent than said retention plates so that the radially outer regions of said circumferentially adjacent edges of said retention plates abut each other.

7. A bladed rotor as claimed in claim 1 wherein the radially inner and outer edges of said retention plates are thickened.

8. A bladed rotor as claimed in claim 1 wherein each of said aerofoil blades has a platform portion interposed between its aerofoil and root portions, said platform portions being interconnected with said retention plates so that said retention plates fix said aerofoil blades axially.

9. A bladed rotor as claimed in claim 8 wherein each of said aerofoil blade platforms defines a portion of one of said retention plate slots.

10. A bladed rotor as claimed in claim 1 wherein some of said retention plates are of different weight than the remainder of said retention plates to facilitate balancing of said bladed rotor.

11. A bladed rotor as claimed in claim 1 wherein said bladed rotor constitutes part of a high pressure compressor of the gas turbine engine.

* * * * *